US008894038B2

(12) United States Patent
Few

(10) Patent No.: US 8,894,038 B2
(45) Date of Patent: Nov. 25, 2014

(54) TRAILER LIFTING JACK

(76) Inventor: Jeffrey P. Few, Elkhart, IN (US)

( * ) Notice: Subject to any disclaimer, the term of this patent is extended or adjusted under 35 U.S.C. 154(b) by 1032 days.

(21) Appl. No.: 12/955,146

(22) Filed: Nov. 29, 2010

(65) Prior Publication Data

US 2012/0132873 A1 May 31, 2012

(51) Int. Cl.
*B66F 3/10* (2006.01)

(52) U.S. Cl.
CPC ..... *B66F 3/10* (2013.01)
USPC ..... 254/102; 254/100

(58) Field of Classification Search
USPC ..... 254/93 R, 100–103, 2 B
See application file for complete search history.

(56) References Cited

U.S. PATENT DOCUMENTS 2,096,022 A 10/1937 Akins
2,096,050 A 10/1937 Lucker
5,123,629 A * 6/1992 Takeuchi ..... 254/103
5,602,887 A * 2/1997 Jensen ..... 376/260
5,664,762 A * 9/1997 Rothbauer ..... 254/103
6,685,169 B2 * 2/2004 Shim ..... 254/103
2005/0161649 A1 * 7/2005 Kawasaki et al. ..... 254/102
2012/0132873 A1 * 5/2012 Few ..... 254/102

* cited by examiner

*Primary Examiner* — Lee D Wilson
(74) *Attorney, Agent, or Firm* — Botkin & Hall, LLP

(57) ABSTRACT

A trailer jack having a low profile which will not interfere with opening of a towing vehicle's tailgate. The jack has tubes telescopically contained within each other. A threaded rod has a threaded tube slidingly placed over it. The threaded tube has slots and a pin in the threaded rod slides within the slots for synchronous rotation. This provides even extension and retractions for the telescoping tubes relative to each other. The jack has a low profile that extends above the trailer tongue a minimal amount when the jack is extended. When the jack is retracted, no parts of the jack are raised above the tongue. Thus, the tailgate of the towing vehicle may be operated without hitting any part of the jack.

6 Claims, 11 Drawing Sheets

TRAILER LIFTING JACK

BACKGROUND OF THE INVENTION

Trailer jacks are commonly used to hold and lift a trailer tongue before hitching to a vehicle. The jacks extend to contact the ground and push against it and also must be retracted to provide clearance for when the trailer is being towed. When the jack is retracted, typically parts of the jack that were below the tongue must be moved above the tongue to provide the necessary ground clearance for being towed. This is a problem because, often times the tailgates of towing vehicles can hit the jack after it is retracted and sticking up above the tongue. Ideally, a trailer jack when fully retracted would have no parts above the trailer tongue to obstruct operation of a towing vehicle's tailgate.

SUMMARY OF THE INVENTION

The present invention has a first tube that contains a threaded member that is rotatably held within the first tube. The threaded member is fixed from axial movement relative to the first tube. A second tube is telescopically contained within the first tube and has female threads that engage the first threaded member so that rotation of the first threaded member causes the second tube to slide axially within the first tube. A second threaded member engages the first threaded member for synchronous rotation with the first member and is movable axially relative to the first threaded member. The second threaded member is fixed from axial movement relative to the second tube. A third tube is telescopically contained within the second tube and has female threads that engage the second threaded member so that rotation of the first and second threaded members causes the third tube to slide axially within the second tube.

The first threaded member can be a threaded rod and the second threaded member can be a threaded tube having external threads. In this case, the inner diameter of the threaded tube is larger than the outer diameter of the threaded rod.

The third tube may include either a flat foot, which is just a piece for resting on a ground surface, or a pivotal foot. The pivotal foot has a gear that is fixed to a shaft that is pivotally retained within the third tube and affixed through the foot. The gear mates with a rack that is fixed relative to the third tube. Movement of the gear over the rack pivotally extends or retracts the foot.

DETAILED DESCRIPTION OF INVENTION

Figure 1:
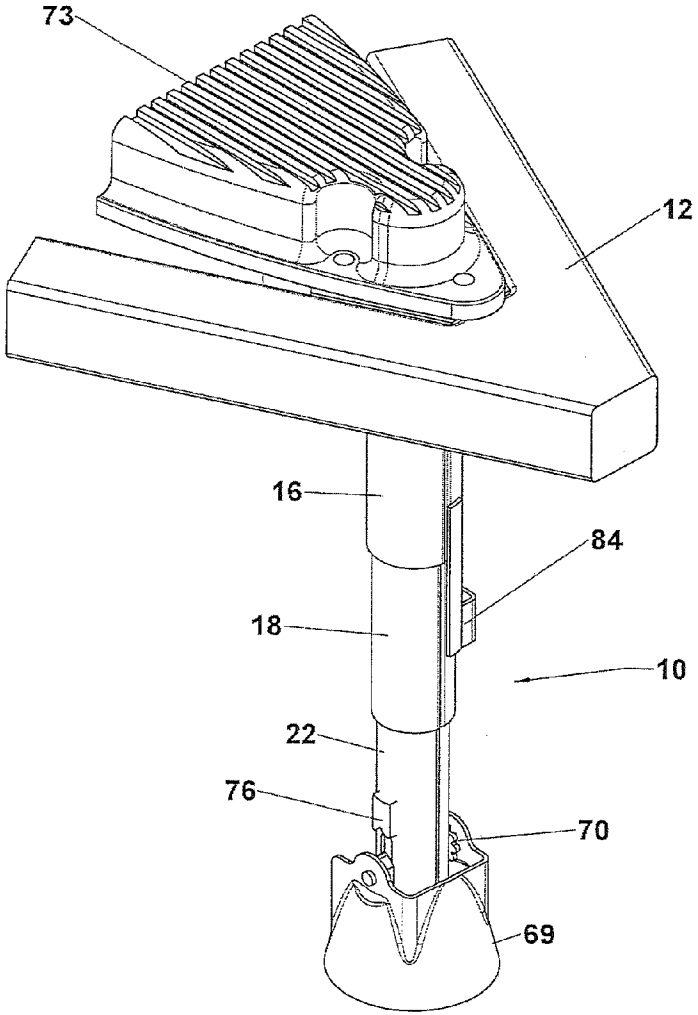
FIG. 1 is a perspective of the trailer jack with a pivotally extendable foot.
Figure 2:
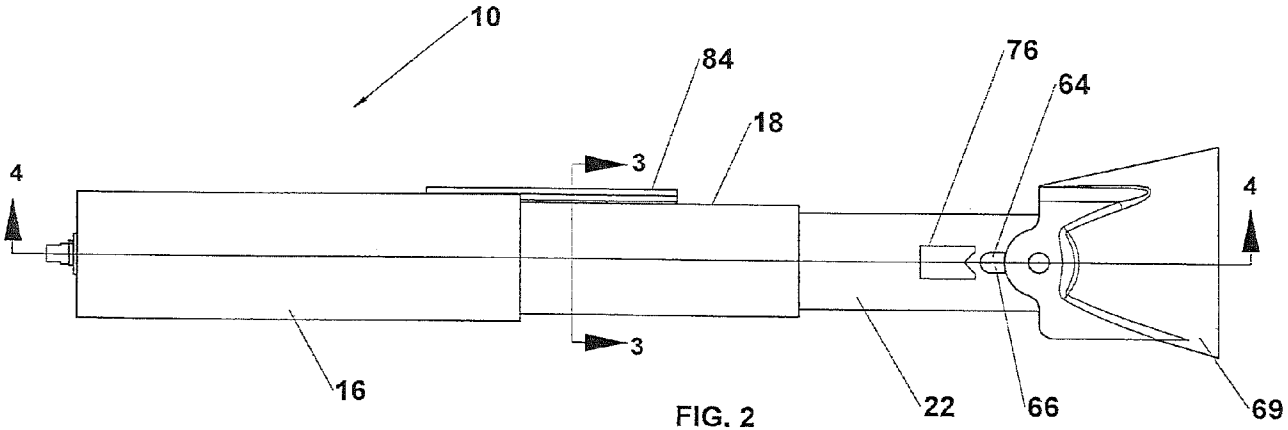
FIG. 2 is a side view of the jack in FIG. 1.
Figure 3:
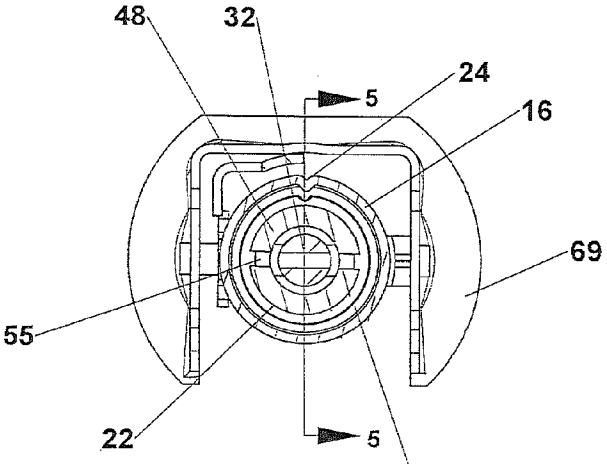
FIG. 3 is a sectional view taken about line 3-3 in FIG. 2.
Figure 4B:
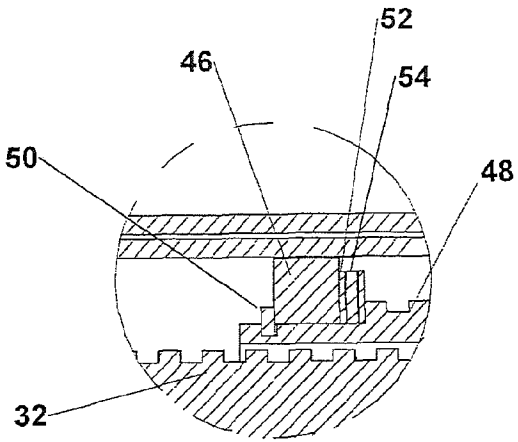
FIG. 4B is a detail view near the top of the threaded tube.
Figure 4A:
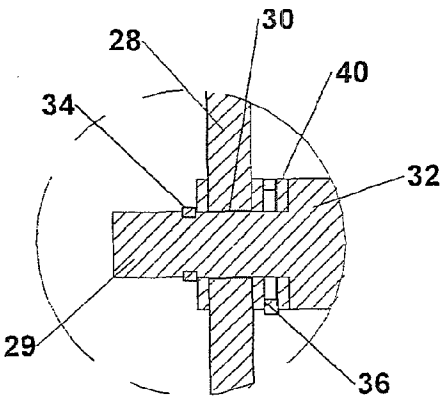
FIG. 4A is a detail view near the top of the threaded rod.
Figure 4:
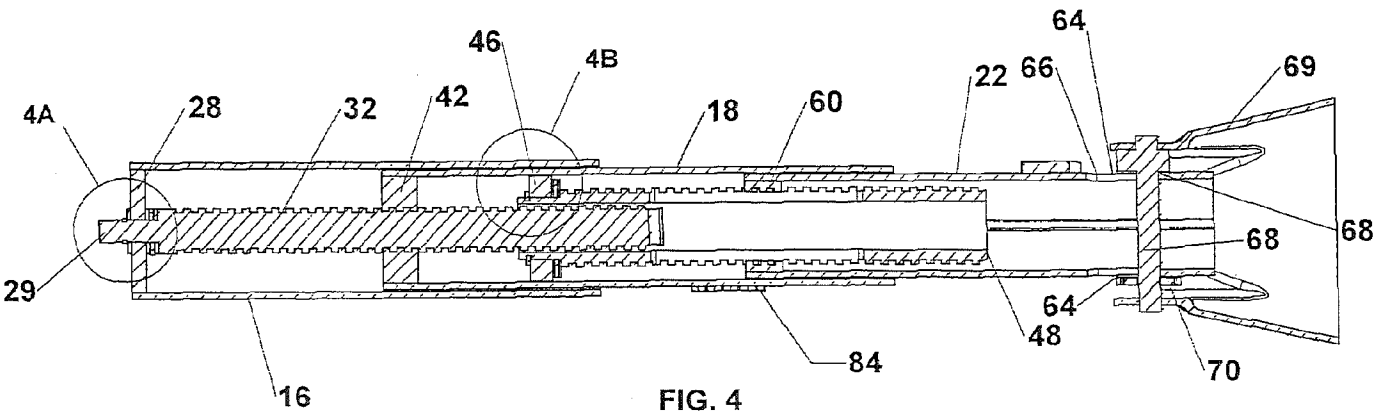
FIG. 4 is a sectional view taken about line 4-4 in FIG. 2.

The present invention is a jack 10 used near the tongue 12 of a trailer to support it when it is unhitched. FIG. 1 shows the tongue 12 without the hitch. The jack 10 shown in FIG. 1 is shown sectioned along its length in FIG. 4. It has an outermost first tube 16 that is fixed to the tongue 12 as shown in FIG. 1. The first tube 16 contains a second tube 18 that is telescopically slidable within the first tube 16. The second tube 18 telescopically contains a third tube 22 that is slidable within the second tube 18. Each of the first, second and third tubes 16, 18, 22 includes a crease 24 as shown in FIG. 3. The creases 24 prevent rotation of each tube 16, 18, 22 with respect to the other tubes, yet allows axial movement. It is contemplated that the tubes 16, 18, 22 could be square or rectangular tubing if desired and using such a tube would eliminate the need for the creases 24 to prevent relative rotation of the tubes 16, 18, and 22. The tubes 16, 18, 22 may be made of any material that can support the weight of a trailer tongue 12 and may be cost effectively made from steel. The first tube has a stop block 28 fixed at its upper end as shown in FIG. 4. The stop block 28 does not move with respect to the first tube 16. It may be secured using semi-pierces or dimples within the outer tube 16 that impinge on the stop block 28 to lock it into place. The stop block 28 has a hole 30 with a smooth inner diameter that accepts a first threaded member that is a threaded rod 32. The threaded rod 32 rotates freely within the stop block 28. The threaded rod 32 is held within the stop block 28 near its upper end 29 with a snap ring 34 above and a thrust bearing 36 below the block 28. This is shown in detail in FIG. 4A. The thrust bearing 36 is between the stop block 28 and a shoulder 40 on the threaded rod 32. The threads on the threaded rod 32 are Acme threads. Turning the threaded rod 32 will move the second tube 18 axially within the first tube 16.

Figure 5:
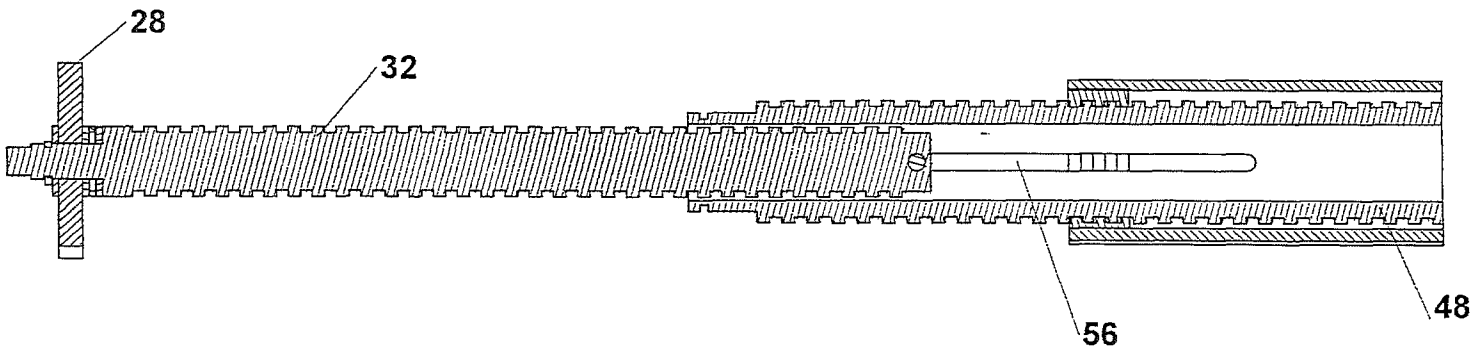
FIG. 5 is a sectional view taken about line 5-5 in FIG. 3 of the threaded rod and threaded tube together, not showing the tubes.

The second tube includes a threaded block 42 having female threads that engage the threaded rod 32. The threaded block 42 is fixed within the second tube 18 and cannot rotate with respect to the second tube 18. As the second tube 18 moves with respect to the first tube, the block 42 moves with the second tube 18. The second tube 18 also includes a second stop block 46. The second stop block 46 is fixed within the second tube 18 and does not move with respect to the second tube 18. The second stop block 46 rotatively holds a second threaded member, which is a threaded tube 48. The threaded tube 48 is held within the stop block above by a snap ring 50 and below by a thrust bearing 52 that rests on a shoulder 54 of the threaded tube 48. The threads on the threaded tube 48 are Acme threads of the same pitch as those on the threaded rod 32. The inner diameter of the threaded tube 48 is slightly larger than the outer diameter of the threaded rod 32. This allows the threaded tube 48 to move axially with respect to the threaded rod 32. The threaded rod 32 includes a pin 55 that protrudes from the threaded rod 32 on both sides and rides in slots 56 on opposite sides the threaded tube 48. FIG. 5A shows a slot 56 in which the pin 55 rides. Thus, the threaded rod 32 and the threaded tube 48 are linked for synchronous rotation and the threaded tube 48 is not prevented from axial movement with respect to the threaded rod 32. During rotation of the threaded rod 32 and threaded tube 48, the position of the pin 55 will change in the slots 56 because the threaded tube 48 will move with the second tube 18, which moves with respect to the first tube 16, and the threaded rod 32 will not move with respect to the first tube 16.

The third tube 22 includes a threaded block 60 having female threads that engage the threaded tube 48. Threaded block 60 is fixed at the upper end of the third tube 22 and cannot rotate with respect to the third tube 22. Rotation of the threaded rod 32 and the threaded tube causes the third tube 22 to move with respect to the second threaded tube 18. As the third tube moves with respect to the second tube 18, the threaded block 60 moves with the second tube 18.

Figure 13A:
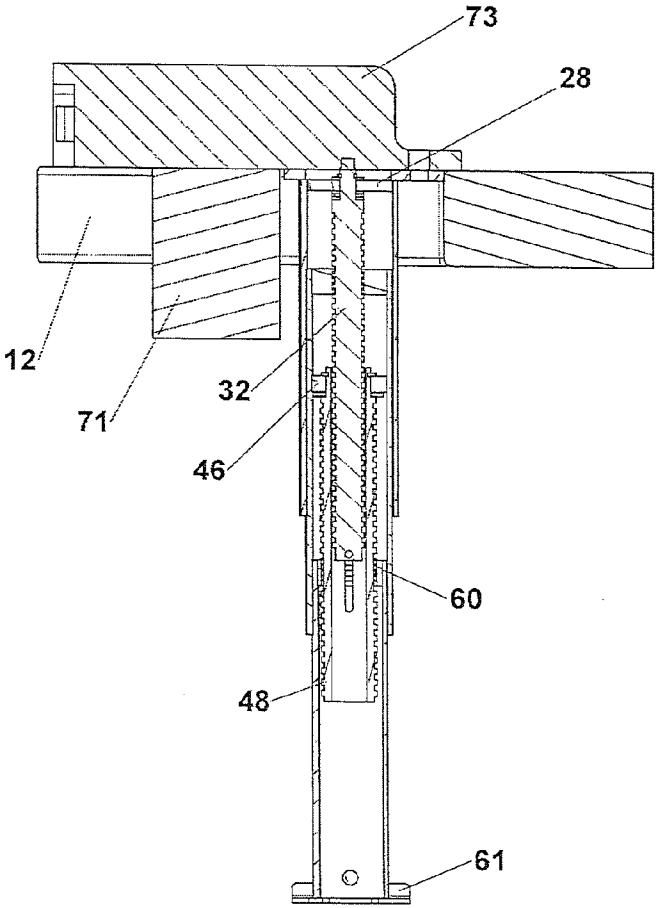
FIG. 13A is a sectional view of the jack taken about line 13A-13A in FIG. 13.
Figure 13:
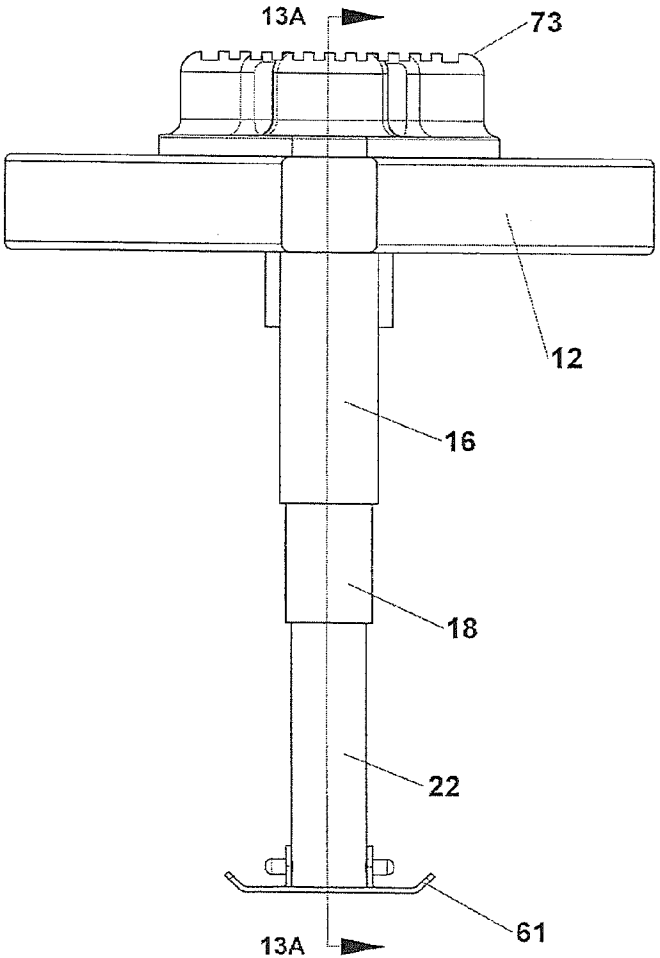
FIG. 13 is a front view of the jack having a fixed foot in its extended position.
Figure 14A:
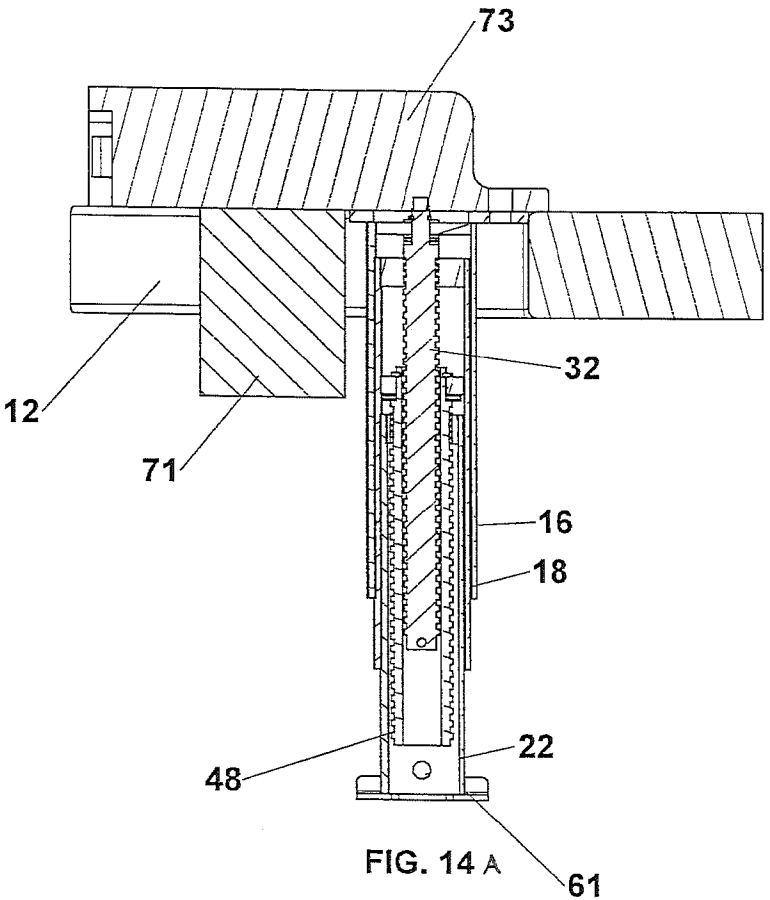
FIG. 14A is a sectional view of the jack taken about line 14A-14A in FIG. 14 similar to FIG. 13 with the jack in its retracted position.
Figure 14:
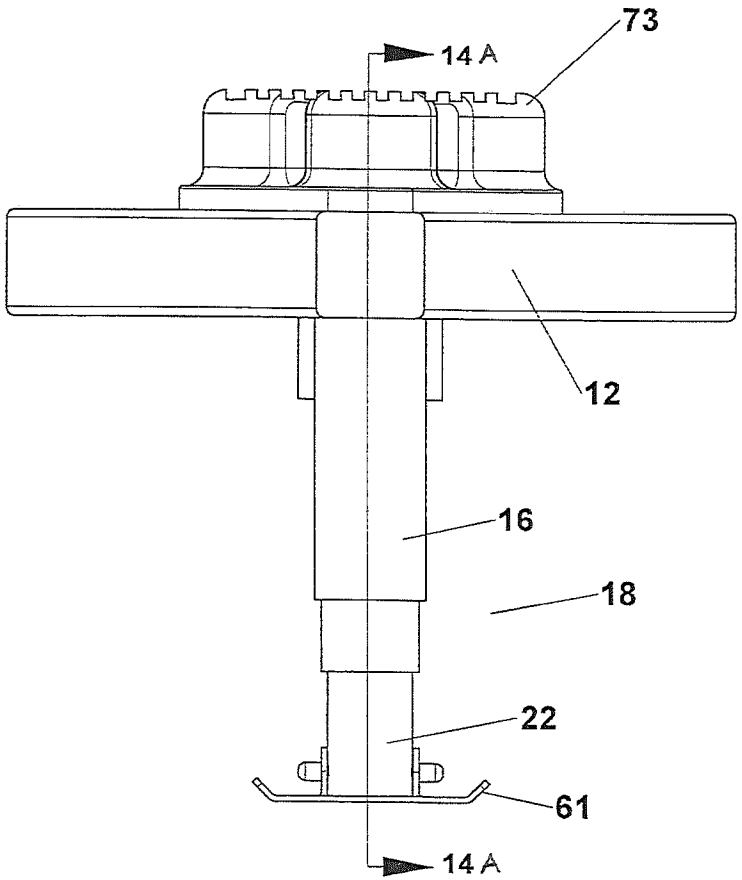
FIG. 14 is a front view of the Jack shown in FIG. 13 in its retracted position.

The threaded rod 32 may be rotated using the motor 71 and gear box 73. This is done by use of a pinion (not shown) that is fixed to the upper end 29 of the threaded rod 32. The threaded rod 32 may also be turned using a fold down handle, as is often done in prior art trailer jacks. In either case, rotation of the threaded rod 32 causes synchronous rotation of the threaded tube 48. Rotation of the threaded rod 32 and tube 48 in one direction causes the jack 10 to extend and rotation in the opposite direction causes the jack 10 to retract. When standard right hand Acme threads are used, turning the threaded rod 32 counterclockwise as viewed from above will extend the jack 10 whereas clockwise rotation will retract the jack 10. FIG. 13 shows a section of a jack 10 using standard Acme threads having a flat foot 61 that does not pivot, with the jack 10 in its extended position. FIG. 14 shows the jack 10 in its retracted position. When the jack 10 is in its retracted position, the threaded block 42 in the second tube is close to the stop block 28 in the top of the first tube 16. The threaded block 60 in the third tube 22 is near the second stop block 46 in the second tube 18. As the threaded rod 32 and tube 48 rotate counterclockwise, the threaded blocks 42, 60 move away from the stop blocks 28, 46 respectively. The fully extended position of the jack 10 shown in FIG. 13A shows the threaded blocks 42, 60 and stop blocks 28, 46 at their farthest apart locations. During extension of the jack 10, the second tube 18 is extended axially from the first tube at a predetermined rate based on rotation of the threaded rod 32, and the third tube 22 is extended axially from the second tube 18 at the same rate. This is because the threads on the threaded rod 32 and threaded tube 48 are the same pitch and they both rotate at the same rate at all times. Thus, the jack 10 is may be rapidly deployed. The thrust bearings 36, 52 support the weight of the tongue 12 when lifted. When the jack 10 is retracted and the foot 61 is not touching the ground 63, the snap rings 34, 50 prevent the threaded rod 32, and threaded tube 48 respectively from falling out of the jack 10.

In the embodiment shown in FIG. 1, the lower end of the third tube 22 has slots 64 on opposite sides of the tube 22, each having an upper end 66 and a lower end 68. FIG. 4 shows the slots 64. The slots 64 carry a shaft 68 that rides within them and is rotatable within the slots 64. The shaft 68 is fixed from rotation with respect to a foot 69 that is held onto the third tube 22 by the shaft 68. A gear 70 fixed on the shaft outside the third tube 22 and rotates with the shaft 68. The shaft 68 also includes a first locking feature 72 that is rigidly affixed to the shaft 68 and rotates with the shaft 68. Although the FIGS. show the gear 70 and locking feature 72 on opposite sides of the shaft, it is contemplated that both could be on the same side of the shaft 68. This might be desirable if the locking feature 72 and gear 70 were cast at the same time. The third tube 22 has a second locking feature 76 rigidly affixed thereon that is complementary to the first locking feature 72. The second locking feature 76 has a negative profile of the protruding triangular shape contained on the first locking feature 72. The second locking feature 76 may be a welded metal boss. It is not necessary that the locking features 72, 76 have complementary triangular shapes as shown in FIGS. 7-10, just that the shapes complement each other when the mating surfaces 78, 80 are in contact. For instance, a rectangle rigidly affixed to the shaft 68 in place of the first locking feature 72 would complement a flat surface on a raised rectangle in place of the second locking feature 76.

Figure 6:
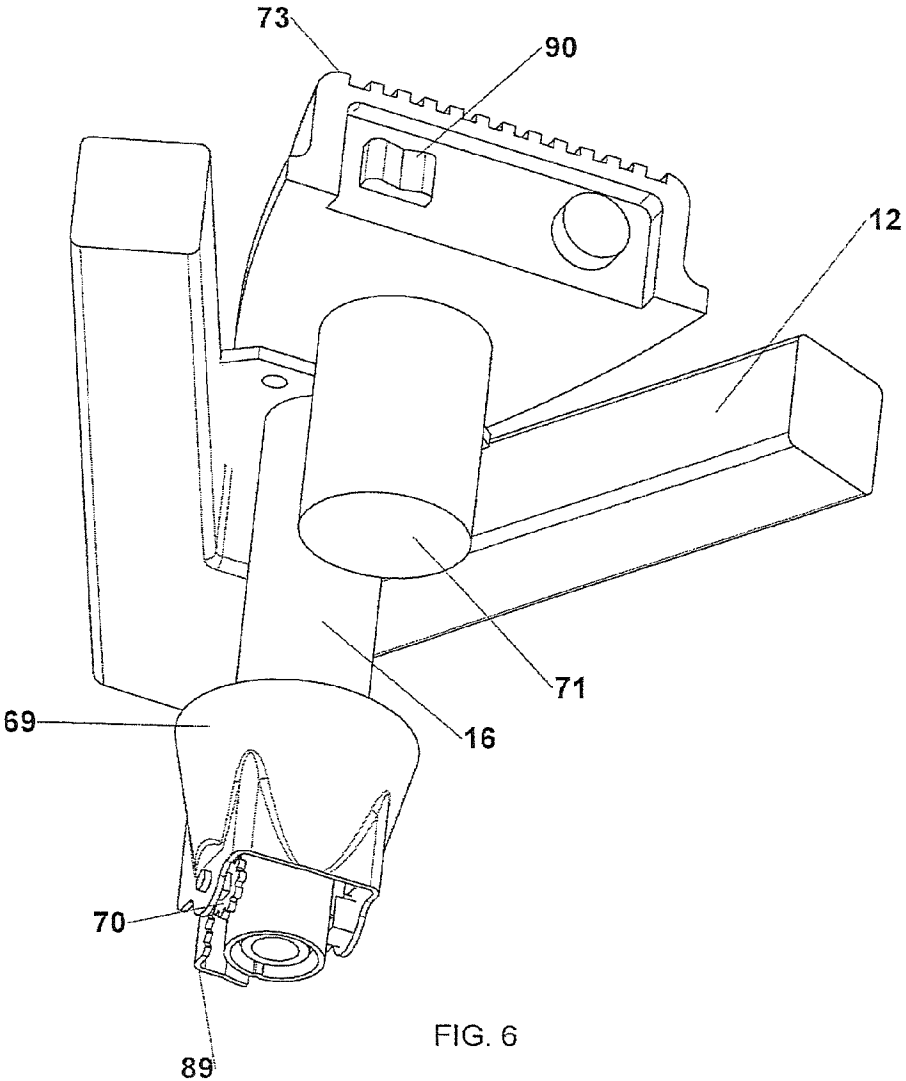
FIG. 6 is a perspective view of the jack in FIG. 1 retracted.

A rack 84 is fixed to the first tube 12 and is designed to mate with the gear 70. When the third tube 22 is positioned near its fully retracted position the gear 70 will be moved along the rack. The fully retracted position of the jack 10 is shown in FIG. 6, and the foot 69 is in its fully retracted position along with the fully retracted third tube 22. As can be seen in FIG. 3 the foot 69 is open facing the rear of the trailer. This allows the foot 69 to be pivoted as the gear 70 is moved along the rack. When the jack 10 is extended, the third tube 22 will be moved downward relative to the stationary rack 84. This will cause the gear 70 to rotate, and thus, rotate the foot downward into its extended position, shown in FIG. 1. The gear 70 and rack are positioned so that approximately 180 degrees of the gear contacts the rack 84. Therefore, the foot 69 will never be rotated more than the necessary 180 degrees needed to move it from its retracted to extended position and vice versa.

Figure 8:
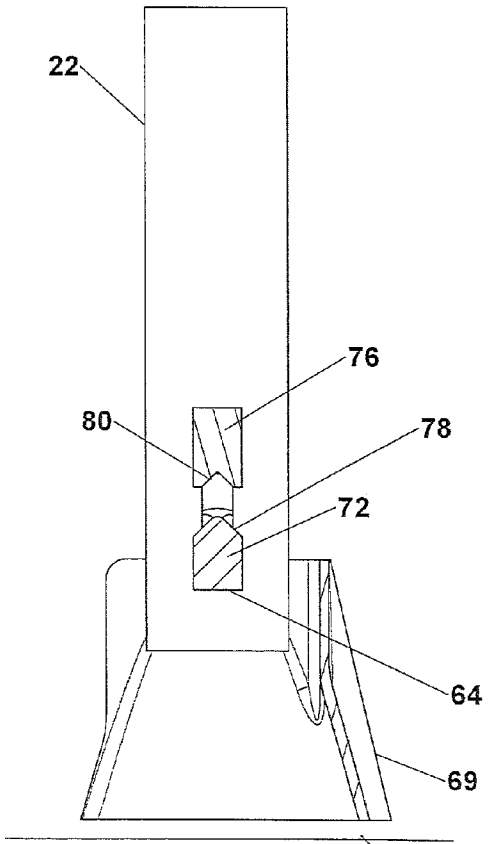
FIG. 8 is a side view of the third tube of the jack shown in FIG. 7, near the ground with the foot not bearing weight.
Figure 7:
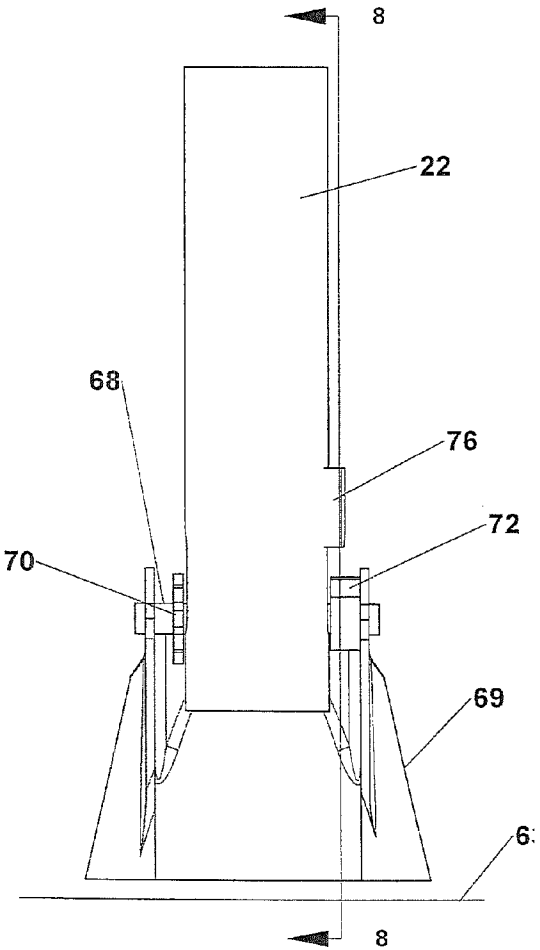
FIG. 7 is a view of the third tube of the jack shown in FIG. 1, near the ground with the foot not bearing weight.
Figure 10:
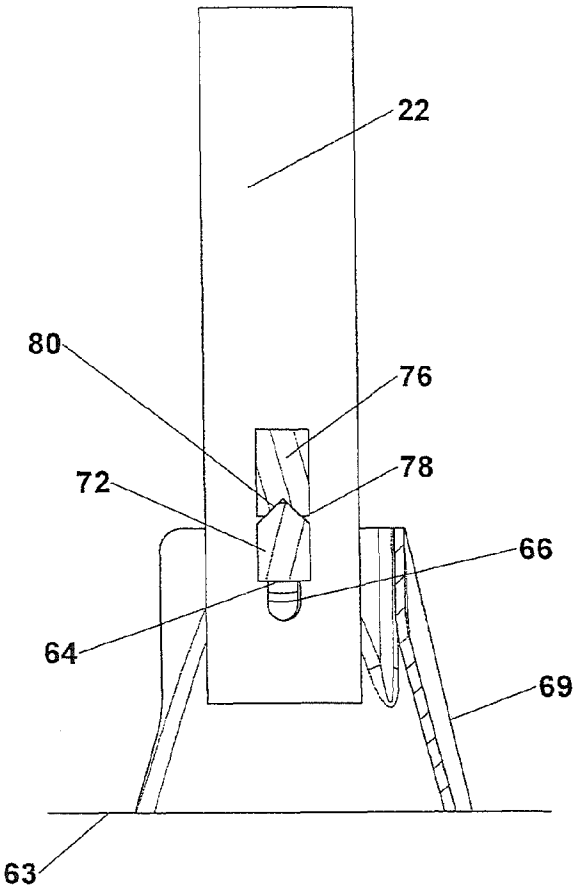
FIG. 10 is a side view of the third tube shown in FIG. 9 touching the ground and bearing weight.
Figure 9:
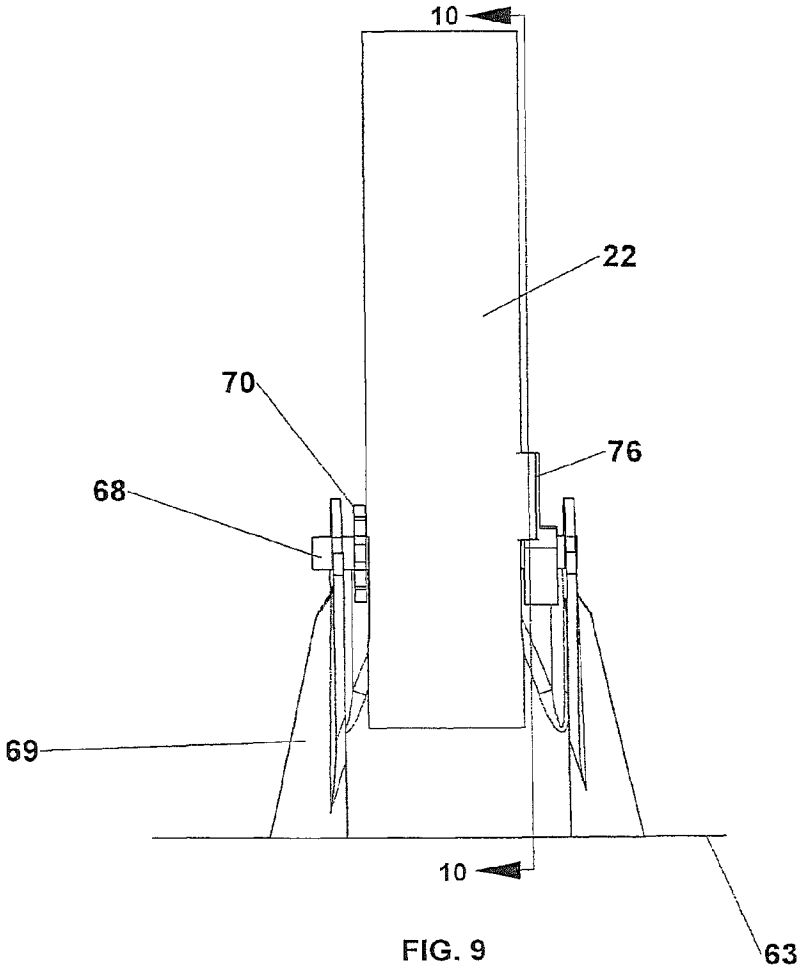
FIG. 9 is a view of the third tube shown in FIG. 7-8 touching the ground and bearing weight.
Figure 11:
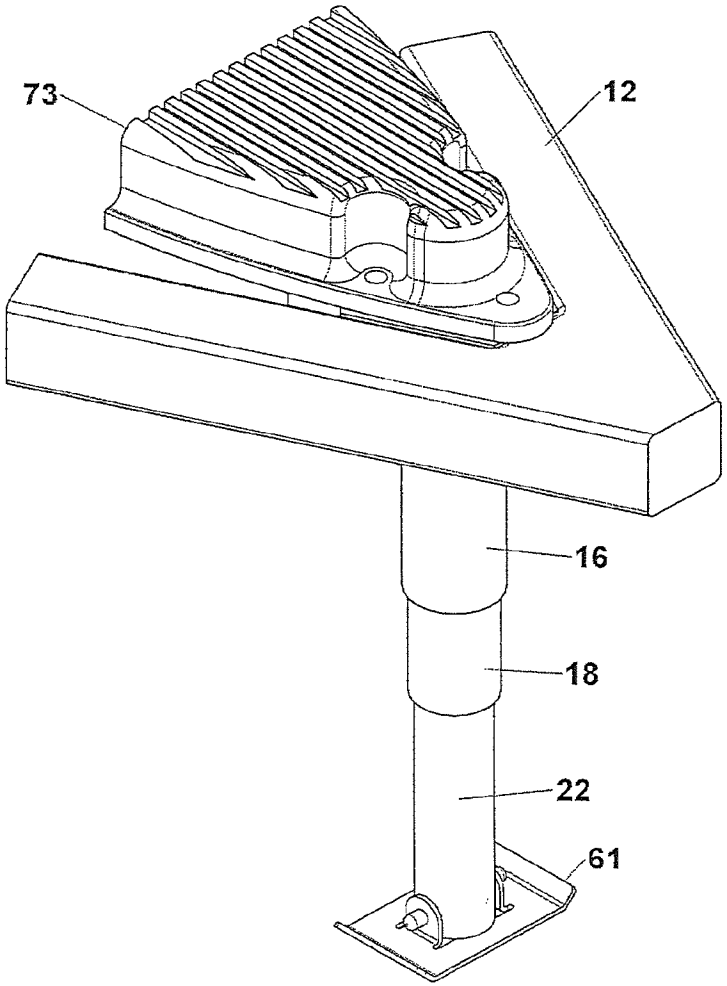
FIG. 11 is a perspective view of the jack with a flat non pivoting foot.

As the jack 10 is extended downward it will ultimately contact the ground 63, which is necessary to support and lift the tongue 12. FIG. 1 shows the jack 10 immediately before the foot 69 contacts the ground 63. FIGS. 7-10 show the third tube 22 on the jack in FIG. 1 in a larger more detailed view near the ground 63. FIGS. 7 and 8 show the foot 69 as it nears the ground surface. In FIGS. 7, 8 the weight of the foot 69 keeps the shaft 68 in the bottom of slots 64. Also, with the foot 69 in the extended position, the first locking feature 72 is pointed upward. FIGS. 9, 10 show the foot 69 on the ground and with the jack 10 bearing weight. In this position, the third tube 22 is pushed down until the first locking feature is contacting the second locking feature 76. The mating surfaces 78, 80 are meshed together and the shaft 68 is in the top of the slot. The position shown in FIGS. 7, 8 provides stability because the foot 69 is prevented from pivoting. This is a safety feature that prevents the foot 69 from accidentally pivoting if the trailer were to roll forward, such as if chocks were not used on the wheels. If the trailer were to roll backward, the shape of the foot would catch on the third tube 22 due to the closed front of the foot 69 even in the absence of the locking features 72, 76.

Figure 12:
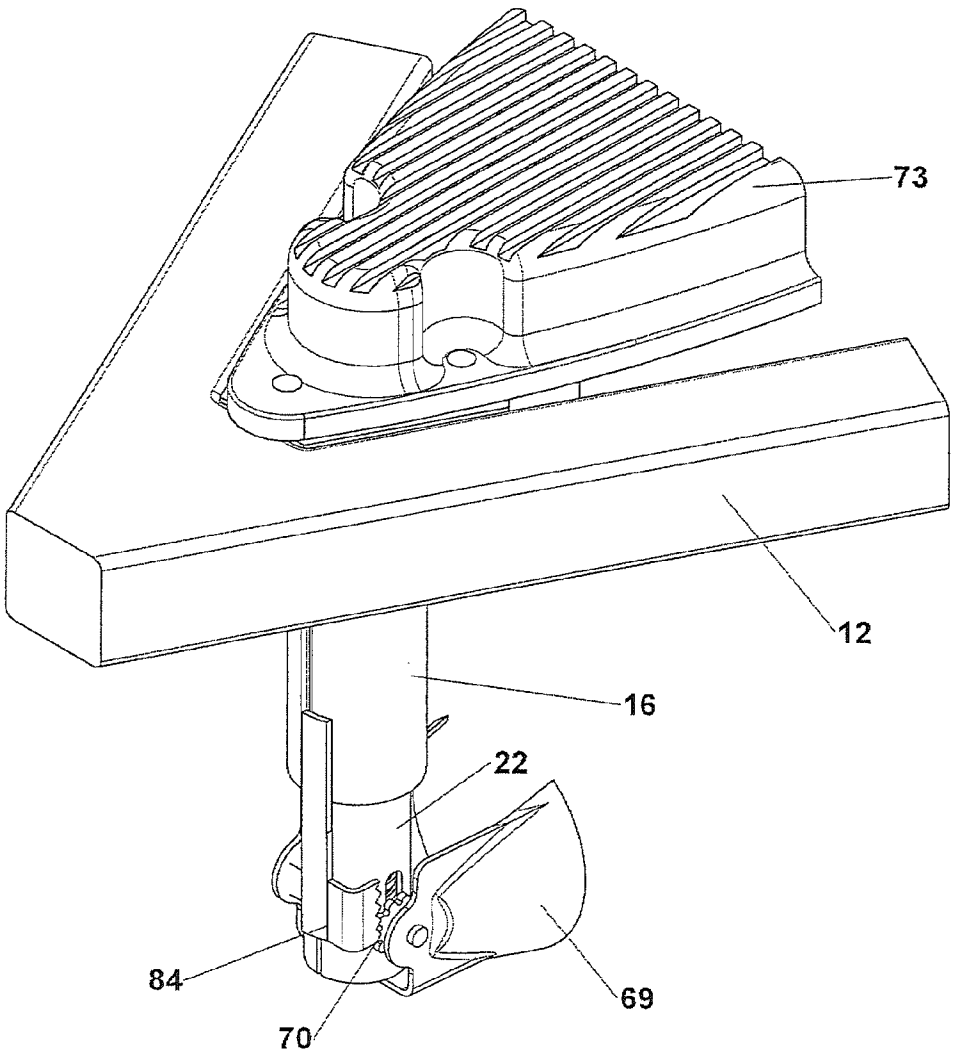
FIG. 12 is a perspective view of the jack having only a first and second tube with a pivotal foot.

The pivotal foot 69 provides an extremely rapid extension and retraction of the jack 10. During extension of the jack 10, all that is necessary to extend the jack 10 the entire length of the foot 69 is movement enough to turn the gear 70, 180 degrees. For instance, if a one inch gear is used, the jack 10 must extend only half of the circumference of the gear. This corresponds to a distance of $\pi$*radius; (½ inch*3.14)=1.57 inches. Thus, the foot 69 is extended or retracted in a mere 1.57 inches. If the foot is twelve inches tall a rather large amount of travel is obtained rather quickly, and this is done before weight is placed on the foot 69. Because of the rapid increase in length that may be made by a jack 10 of the configuration shown in FIG. 1, in certain applications it may be desirable to have the foot 69 placed in the second tube 18 and have no third tube 22. FIG. 12 shows a jack 10 having only a first and second tube 16, 18 with a foot 69.

When a user of the jack 10 wishes to extend the jack 10 to lift the tongue 12 of a trailer he will move the toggle switch 90 located on the back of the gear box 73 to turn the motor 71 in the direction necessary to extend the jack 10. As mentioned above, in all the embodiments, the tubes 16, 18, 22 will extend with respect to each other until reaching the ground 63. At that point the user will hold the toggle switch 90 until the tongue 12 is lifted to its desired height. Electronic controls within the gear box 73 will prevent the jack from overextending. Once the trailer is hitched to a towing vehicle, the jack 10 is retracted with the opposite procedure.

In its fully retracted position, the jack 10 has no parts extending over the gear box 73. Because of the telescoping design, achieving ground clearance beneath the tongue 12 necessary to tow the trailer can be had without moving any parts of the jack 10 above the tongue 12. This enables tailgates of towing vehicles to be opened above the tongue 12 without hitting parts above the tongue, which is a problem with prior art trailer jacks.

The invention is not limited to the details given above, but may be modified within the scope of the following claims.

What is claimed is:

1. A jack comprising:

a first tube containing a first threaded member being rotatably held within said first tube and fixed from axial movement relative to said first tube, said first tube including a push block near an upper end of said first tube through which said first threaded member rotates, said push block being fixed to said first tube;

a second tube telescopically contained within said first tube having a push block near an upper end of said second tube through which said first threaded member rotates, said push block being fixed to said second tube, said second tube having female threads engaging said first threaded member such that rotation of said first threaded member causes said second tube to slide axially within said first tube;

a threaded tube having external threads and an inner diameter larger than said first threaded member and said threaded tube being telescopically slidable over said first threaded member, said threaded tube including a slot, said first threaded member including a pin for engaging said slot in said second threaded member for synchronous rotation with said threaded tube and said threaded tube being movable axially relative to said first threaded member, said threaded tube being fixed from axial movement relative to said second tube;

a third tube is telescopically contained within said second tube having female threads engaging said second threaded member such that rotation of said first and second threaded members causes said third tube to slide axially within said second tube; and said first, said second, and said third tubes being fixed from rotation relative to each other.

2. The jack claimed in claim 1, wherein said third tube is shiftable between a retracted position and an extended position, said third tube includes a foot being pivotable about a shaft rotatably mounted to said third tube, said shaft being fixed with respect to said foot, said shaft including a gear fixed with rotation relative to said shaft, a rack fixed relative to said third tube, said gear mateable with said rack for a portion of positions intermediate to said retracted and extended positions, rotation of said gear causing rotation of said foot.

3. The jack as claimed in claim 2, wherein said foot is rotatably movable between a retracted upward position an extended downward position, said gear and rack having sufficient contact to rotate said foot between said refracted and extended positions.

4. The jack as claimed in claim 1, wherein said third tube includes a slot having an upper and lower end for slidably and rotatably containing said shaft, said shaft being shiftable between a lower and upper position in said slot, said shaft occupying said upper position when said jack is bearing weight and said foot is contacting a ground surface.

5. The jack as claimed in claim 4, wherein said shaft includes a first locking feature fixed on said shaft from rotation relative to said shaft, said third tube including a second locking feature complimentary to said first locking feature adjacent to said upper end of said slot, said second locking feature locking said shaft from rotation when said locking features are held together.

6. The jack as claimed in claim 5, wherein said first and second locking features are held together when said foot is bearing weight on said ground surface.

* * * * *